US008744289B2

(12) United States Patent
Shimura

(10) Patent No.: US 8,744,289 B2
(45) Date of Patent: Jun. 3, 2014

(54) IMAGE FORMING APPARATUS

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 13/316,280

(22) Filed: Dec. 9, 2011

(65) Prior Publication Data

US 2012/0155895 A1 Jun. 21, 2012

(30) Foreign Application Priority Data

Dec. 15, 2010 (JP) ..... 2010-279884

(51) Int. Cl.
*G03G 15/20* (2006.01)

(52) U.S. Cl.
USPC ..... 399/33; 399/69

(58) Field of Classification Search
USPC ..... 399/33, 37, 88, 67, 69
See application file for complete search history.

(56) References Cited

U.S. PATENT DOCUMENTS 5,229,577 A 7/1993 Matsuura
6,522,844 B2 * 2/2003 Yamane et al. ..... 399/67
6,870,140 B2 * 3/2005 Cook et al. ..... 219/486
7,076,183 B2 * 7/2006 Kawazu et al. ..... 399/69
7,308,216 B2 * 12/2007 Kishi et al. ..... 399/70

FOREIGN PATENT DOCUMENTS

JP 7-121055 A 5/1995
JP 7-199702 A 8/1995
JP 3919670 B2 5/2007
JP 2007-212503 A 8/2007
JP 2008003469 A * 1/2008 ..... G03G 15/20
JP 2010-199066 A 9/2010

OTHER PUBLICATIONS

Machine translation of Kawazu, JP 2007-212503. Aug. 23, 2007.*

* cited by examiner

*Primary Examiner* — David Gray
*Assistant Examiner* — Carla Therrien
(74) *Attorney, Agent, or Firm* — Canon USA, Inc., IP Division

(57) ABSTRACT

The present invention provides a low-cost and safe image forming apparatus that has a first state in which first and second resistance heating bodies of a heater are connected in series, a second state in which the first and second resistance heating bodies are connected in parallel, and a third state in which a first switching unit shuts off a power supply path and a second switching unit is connected to a first power source terminal to block power supply to the heater.

5 Claims, 11 Drawing Sheets

IMAGE FORMING APPARATUS

BACKGROUND OF THE INVENTION

1. Field of the Invention

The present invention relates to an image forming apparatus such as a copier and a laser-beam printer, and in particular to an image forming apparatus including a fixing section including an endless belt, a heater that contacts the inner surface of the endless belt, and a nip portion forming member that forms a fixing nip portion together with the heater via the endless belt.

2. Description of the Related Art

An image forming apparatus for use in an area where the commercial power source voltage is around 100 V (for example, 100 V to 127 V) may be used in an area where the commercial power source voltage is around 200 V (for example, 200 V to 240 V). In such a case, the maximum power that can be supplied to the heater of the fixing section may be quadrupled compared to a case where the apparatus is used in the 100-V area. As the maximum power that can be supplied to the heater becomes larger, a harmonic current, flicker, or the like produced in heater power control such as phase control and wave number control becomes more significant. In addition, power produced when thermal runaway occurs in the fixing section is quadrupled, which requires a more responsive circuit. Therefore, in many cases, a single apparatus that may be used in both the 100-V area and the 200-V area is provided with heaters with different resistance values for the respective areas.

Meanwhile, a technique for changing the resistance value of a heater using switching units such as relays is proposed to provide a universal apparatus that may be used in both an area where the commercial power source voltage is 100 V and an area where the commercial power source voltage is 200 V. Japanese Patent Laid-Open No. 7-199702 proposes an apparatus including first and second resistance heating bodies provided on a heater substrate. Switching can be made between a first operating state, in which the first and second resistance heating bodies are connected in series with each other, and a second operating state, in which the first and second resistance heating bodies are connected in parallel with each other, to change the resistance value of the heater in accordance with the commercial power source voltage in order to allow the apparatus to be used in both the 100-V area and the 200-V area.

According to the technique for switching the first and second resistance heating bodies between the series connection state and the parallel connection state in accordance with the commercial power source voltage, the resistance value of the heater may be changed without changing the heating region of the heater. In other words, both the two resistance heating bodies generate heat irrespective of whether the apparatus is used in the 100-V area or the 200-V area. Thus, the temperature distribution in the fixing nip portion in the recording material conveying direction is the same irrespective of the area of use. This is advantageous in that the fixing performance of toner images is not affected by the area where the apparatus is used.

A technique that uses power shutoff elements such as relays is widely employed as safety measures for a case where power supply to a heater may not be controlled to cause thermal runaway of the heater. In addition, a technique in which relays are provided on both sides of a heater to insulate the heater from an alternating-current power source for electric shock prevention is also known. However, separately providing power shutoff relays as safety measures to the apparatus in which the first and second resistance heating bodies are switched between the series connection state and the parallel connection state using the connection state switching relays as described in Japanese Patent Laid-Open No. 7-199702 would increase the cost.

SUMMARY OF THE INVENTION

The present invention provides an image forming apparatus in which first and second resistance heating bodies are switched between the series connection state and the parallel connection state and the safety measures for the apparatus are improved while suppressing a cost increase.

In accordance with one aspect of the present invention an image forming apparatus includes an image forming section that forms an image on a recording material, a fixing section that fixes the image on the recording material onto the recording material, the fixing section including an endless belt, a heater that includes a first resistance heating member provided between a first electrode and a second electrode and a second resistance heating member provided between the second electrode and a third electrode and that contacts an inner surface of the endless belt, and a nip portion forming member that forms a fixing nip portion together with the heater via the endless belt, the fixing nip portion being configured to pinch and convey the recording material carrying the image, a first switching unit provided on a power supply path between the second electrode and a second power source terminal of a commercial power source, and a second switching unit provided on the power supply path so as to switch whether the first electrode is connected to a first power source terminal of the commercial power source or the second power source terminal, in which the third electrode is connected to the first power source terminal, in which the image forming apparatus is switchable between a first state in which the first switching unit shuts off the power supply path and the second switching unit is connected to the second power source terminal to connect the first resistance heating member and the second resistance heating member in series with each other, and a second state in which the first switching unit closes the power supply path and the second switching unit is connected to the first power source terminal to connect the first resistance heating member and the second resistance heating member in parallel with each other, and in which the image forming apparatus has a third state in which the first switching unit shuts off the power supply path and the second switching unit is connected to the first power source terminal to block power supply to the heater.

Further features of the present invention will become apparent from the following description of exemplary embodiments with reference to the attached drawings.

DESCRIPTION OF THE EMBODIMENTS

Figure 9:
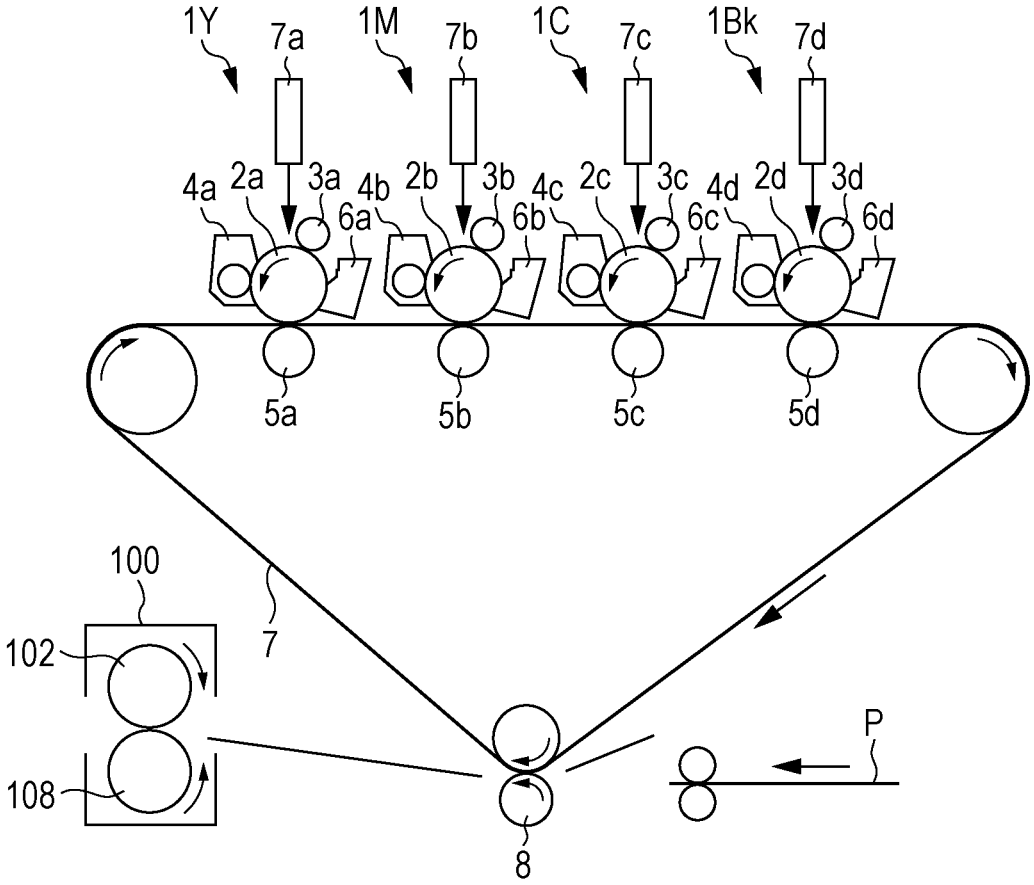
FIG. 9 is a schematic diagram of an image forming apparatus.

FIG. 9 is a cross-sectional view of an image forming apparatus (in the example, a full-color printer) that uses electrophotographic recording technology. An image forming section that forms a toner image on a recording material P includes four image forming stations (1Y, 1M, 1C, and 1Bk). Each of the image forming stations includes a photosensitive member 2 (2*a*, 2*b*, 2*c*, 2*d*), a charging member 3 (3*a*, 3*b*, 3*c*, 3*d*), a laser scanner 7 (7*a*, 7*b*, 7*c*, 7*d*), a developer 4 (4*a*, 4*b*, 4*c*, 4*d*), a transfer member 5 (5*a*, 5*b*, 5*c*, 5*d*), and a cleaner 6 (6*a*, 6*b*, 6*c*, 6*d*) that cleans the photosensitive member 2. The image forming section further includes a belt 7 that carries and conveys the toner image, and a secondary transfer roller 8 that transfers the toner image from the belt 7 onto the recording material P. An operation of the image forming section described above is known in the art, and thus is not described herein. After the image forming section transfers an unfixed toner image onto the recording material P, the recording material P is fed to a fixing section 100, where the toner image is fixed onto the recording material P through heating.

Figure 1:
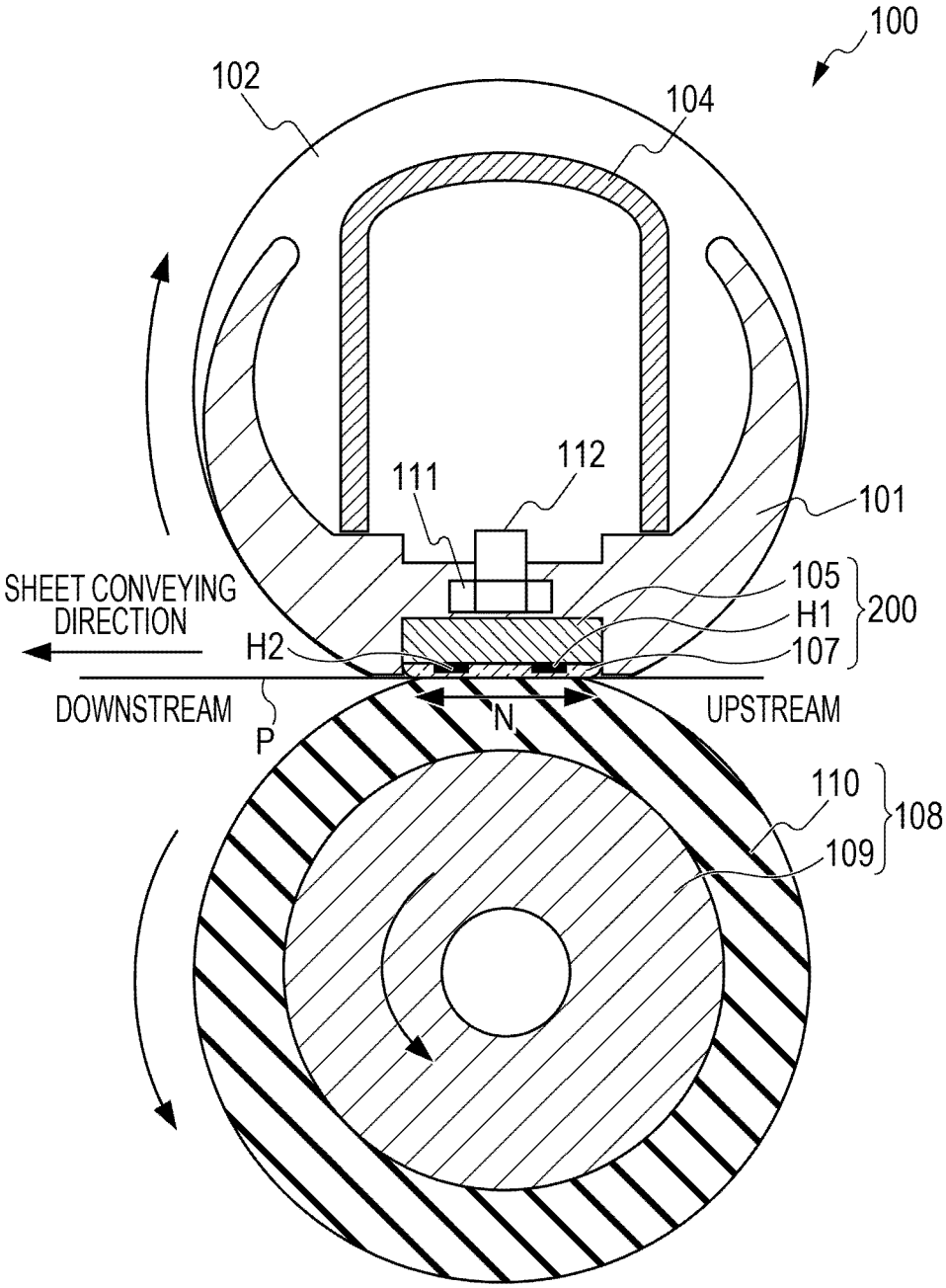
FIG. 1 is a cross-sectional view of a fixing section.

FIG. 1 is a cross-sectional view of a fixing apparatus (fixing section) 100. The fixing apparatus 100 includes a cylindrical film (endless belt) 102, a heater 200 that contacts the inner surface of the film 102, and a pressing roller (nip portion forming member) 108 that forms a fixing nip portion N together with the heater 200 via the film 102. The material of a base layer of the film 102 is a heat-resistant resin such as polyimide or a metal such as stainless steel. The pressing roller 108 includes a core metal 109 made of a material such as iron and aluminum, and an elastic layer 110 made of a material such as silicone rubber. The heater 200 is held by a holding member 101 made of a heat-resistant resin. The holding member 101 also has a guide function of guiding rotation of the film 102. The pressing roller 108 receives power from a motor (not shown) to rotate in the direction of the arrow. Rotation of the pressing roller 108 drives the film 102 to rotate.

The heater 200 includes a heater substrate 105 made of ceramics, a resistance heating member H1 (first resistance heating member) and a resistance heating member H2 (second resistance heating member) provided on the heater substrate 105, and a surface protecting layer 107 made of an insulating material (in the embodiment, glass) to cover the resistance heating bodies H1 and H2. A temperature detecting element (temperature detecting portion) 111 such as a thermistor abuts against the back surface of the heater substrate 105 over a region where paper of the smallest size supported by the printer (in the example, envelope DL, which is 110-mm wide) passes. Power supplied from a commercial alternating-current power source to the heater 200 is controlled in accordance with the temperature detected by the temperature detecting element 111. The recording material (sheet) P carrying an unfixed toner image is heated for fixation while being pinched and conveyed by the fixing nip portion N. A safety element 112 such as a thermoswitch also abuts against the back surface of the heater substrate 105. The safety element 112 is actuated to shut off a power feed line to the heater 200 when the temperature of the heater 200 rises abnormally. The safety element 112 also abuts over the region where paper of the smallest size passes as with the temperature detecting element 111. Reference numeral 104 denotes a metal stay that applies the pressure of a spring (not shown) to the holding member 101.

(First Embodiment)

Figure 2A:
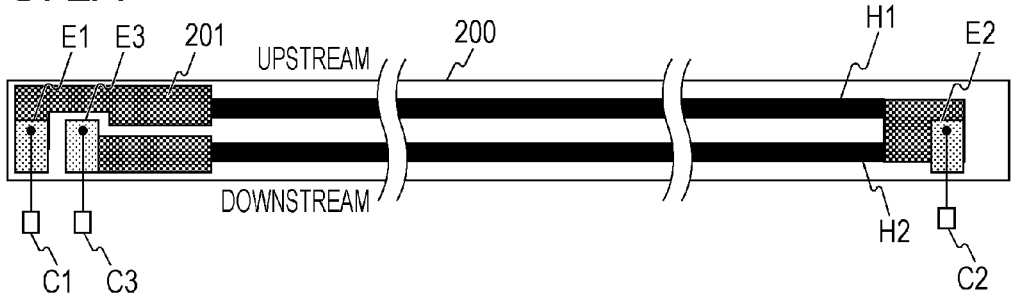
FIGS. 2A and 2B show the configuration of a heater and a heater control circuit, respectively, according to a first embodiment.
Figure 2B:
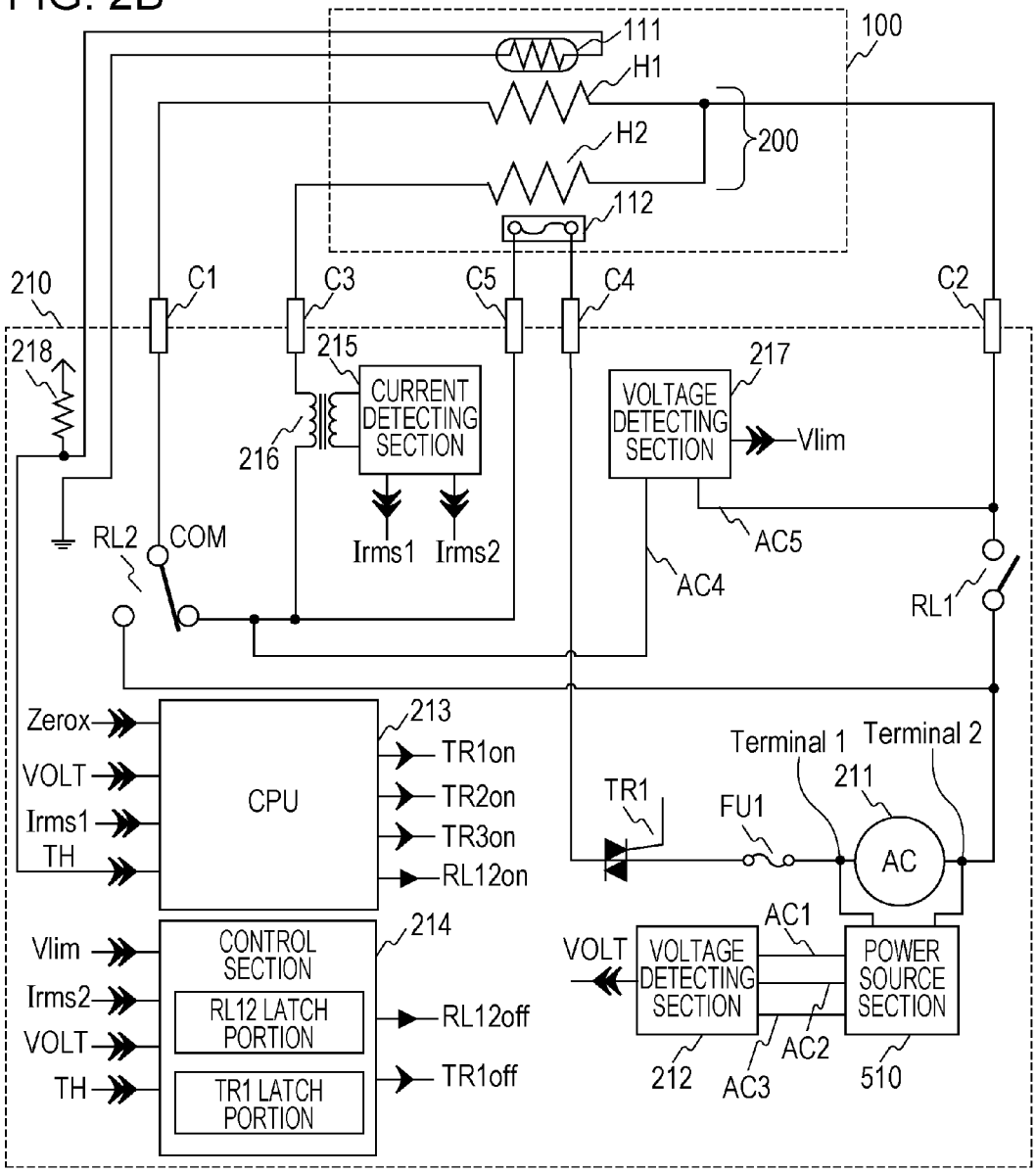

FIGS. 2A and 2B show the heater 200 and a control circuit 210 that controls the fixing section 100, respectively, according to the first embodiment. FIG. 2A shows the configuration of the heater 200 used in the first embodiment. FIG. 2B is a circuit block diagram of the control circuit 210. In the fixing section 100 on which the heater 200 is mounted, the first and second resistance heating bodies H1 and H2 may be switched between the series connection state and the parallel connection state as in the apparatus described in the "Description of the Related Art" section.

FIG. 2A shows heating patterns (resistance heating bodies), conductive patterns, and electrodes formed on the substrate 105. The heater 200 and the control circuit 210 are connected to each other through connectors C1 to C5.

The heater 200 includes the first resistance heating member H1 provided between a first electrode E1 and a second electrode E2, and the second resistance heating member H2 provided between the second electrode E2 and a third electrode E3. Reference numeral 201 denotes a conductive pattern that connects between an electrode and a resistance heating member. In the heater 200, power is supplied to the first resistance heating member H1 via the electrode E1 and the electrode E2, and to the second resistance heating member H2 via the electrode E2 and the electrode E3. The electrodes E1, E2, and E3 are connected to the connectors C1, C2, and C3, respectively. Reference numeral 112 denotes a safety element such as a thermoswitch and a thermal fuse provided in a power supply line (power supply path) from a commercial power source 211 to the heater 200. The safety element 112 is connected to the control circuit 210 via the connectors C4 and C5.

The control circuit 210 will be described with reference to FIG. 2B. The heater 200 is supplied with power by way of the safety element 112. Reference numeral 211 denotes a commercial alternating-current (AC) power source. Power for the heater 200 is controlled by energizing/de-energizing a triac TR1 (semiconductor drive element). The triac TR1 is provided on a path through which power is supplied from Terminal 1 (first power source terminal) of the commercial power source 211 to the heater 200. The triac TR1 operates in accordance with a heater drive signal TR1on from a CPU 213. The temperature of the heater 200 is detected by the temperature detecting element 111 as a divided voltage for a pull-up resistor 218, and input to the CPU 213 as a TH signal. Inside the CPU 213, power to be supplied to the heater 200 is calculated through PI control, for example, on the basis of the temperature detected by the temperature detecting element 111 and the temperature set for the heater 200 (control target temperature). The calculated power is converted into control levels such as phase angle (phase control) and wave number (wave number control). The heater drive signal TR1on corresponding to the control levels is fed to the triac TR1 to control the triac TR1. The control timing of the triac TR1 is controlled by the CPU 213 on the basis of a Zerox signal (a zero-cross signal with the alternating-current waveform of the AC power source 211) output from a zero-cross detection circuit 518 in FIG. 5A.

As shown in FIG. 2B, the control circuit 210 is provided with a relay RL1 and a relay RL2. The relay RL1 is a make-contact (normally open contact) relay (first switching unit). The relay RL2 is a break-before-make-contact (transfer contact) relay (second switching unit) that operates with COM in FIG. 2B serving as a common contact. The relay RL1 is provided on a power supply path between the second electrode E2 and Terminal 2 (second power source terminal) of the commercial power source 211. The relay RL2 is provided on the power supply path so as to switch whether the first electrode E1 is connected to Terminal 1 (first power source terminal) or Terminal 2 (second power source terminal) of the commercial power source 211. The relay RL1 and the relay RL2 serve to switch the first resistance heating member H1 and the second resistance heating member H2 between the series connection state (first state) and the parallel connection state (second state). The relay RL1 and the relay RL2 further serve to bring the fixing section 100 into a state (third state) in which power supply from the commercial power source 211 to the heater 200 is blocked. The control circuit 210 includes a voltage detecting section 212 that detects the commercial power source voltage, and automatically switches between the first state and the second state in accordance with the voltage detected by the voltage detecting section 212.

The image forming apparatus is turned off with the relay RL1 and the relay RL2 in the state shown in FIG. 2B. This state is the third state discussed above, in which the relay RL1 (first switching unit) shuts off the power supply path (the relay RL1 is open) and the relay RL2 (second switching unit) is connected to Terminal 1 (first power source terminal) of the commercial power source 211. The third state is established by bringing all of drive voltages (drive power) Vcc for a relay RL1 drive circuit (FIG. 3A), a relay RL2 drive circuit (FIG. 3B), and a triac TR1 drive circuit (FIG. 3C) to be discussed later to 0 V. That is, in the third state, drive power for the relay RL1 (first switching unit) and the relay RL2 (second switching unit) has been shut off. The state of the relay RL1 and the relay RL2 in the first state and the second state discussed above will be discussed in detail later.

Next, the voltage detecting section (first voltage detecting section) 212 which is a circuit that detects the commercial power source voltage and a relay control section 214 will be described. A relay control sequence will be described in detail with reference to FIG. 6.

When a print signal is input to the image forming apparatus, the CPU 213 produces a TR3on signal to turn on a triac TR3 (FIG. 5A) that drives an AC/DC converter 511 (FIG. 5A) in a power source section 510 that generates a 3.3-V direct voltage and a 24-V direct voltage. When the triac TR3 is turned on, the voltage detecting section 212 becomes able to detect the voltage of the alternating-current power source 211, and detects the voltage of the alternating-current power source 211. The voltage detecting section 212 determines whether the range of the commercial power source voltage is around 100 V or around 200 V, and outputs a VOLT signal indicating the voltage detection results to the CPU 213 and the relay control section 214. In the case where the range of the commercial power source voltage is around 200 V, the VOLT signal is set to Low. The voltage detecting section 212 will be described in detail with reference to FIG. 5B.

Figure 4A:
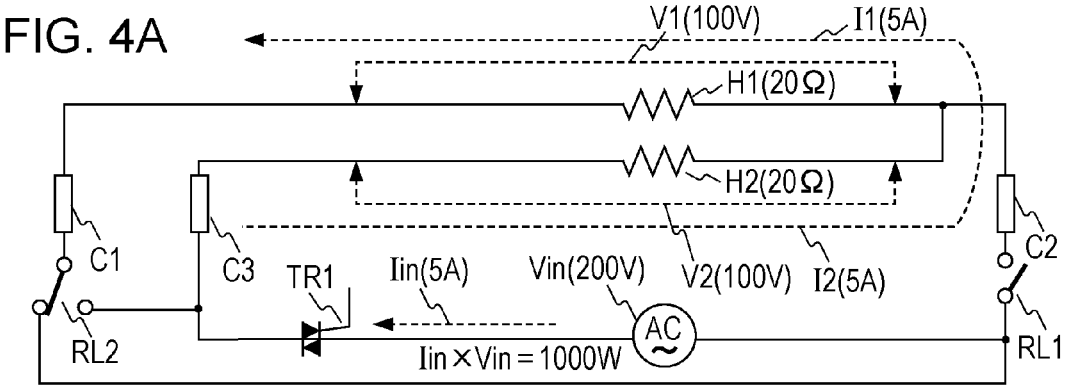
FIGS. 4A to 4D illustrate a first state, a second state, and a third state according to the first embodiment.

In the case where the voltage detecting section 212 detects 200 V (the VOLT signal is set to Low), the CPU 213 sets an RL12on signal to Low. When the RL12on signal is set to Low, the relay RL1 is turned off (to shut off the power supply path), and the relay RL2 is turned on (to be connected to the left contact in FIG. 2B). In this state, the first resistance heating member H1 and the second resistance heating member H2 are connected in series with each other so that the heater 200 has a large resistance value (first state). The first state is shown in FIG. 4A. A latch circuit that holds the RL12on signal at Low in the case where the voltage detecting section 212 detects 200 V may be used. In the first state, the first switching unit shuts off the power supply path and the second switching unit is connected to Terminal 2 (second power source terminal) of the commercial power source 211 to connect the first resistance heating member and the second resistance heating member in series with each other.

Figure 4B:
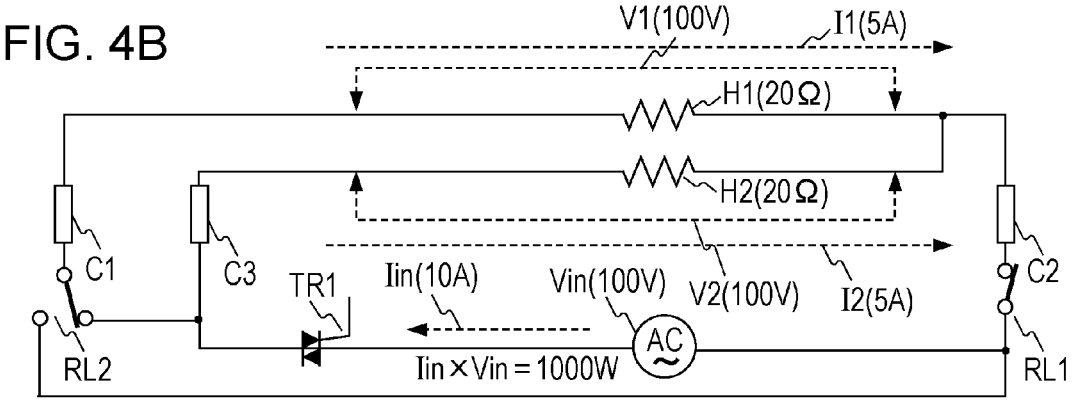

In the case where the voltage detecting section 212 detects 100 V (the VOLT signal is set to High), the CPU 213 sets the RL12on signal to High. When the RL12on signal is set to High, the relay RL1 is turned on (to close the power supply path), and the relay RL2 is turned off (to be connected to the right contact in FIG. 2B). In this state, the first resistance heating member H1 and the second resistance heating member H2 are connected in parallel with each other so that the heater 200 has a small resistance value (second state). The second state is shown in FIG. 4B. In the second state, the first switching unit closes the power supply path and the second switching unit is connected to Terminal 1 (first power source terminal) to connect the first resistance heating member and the second resistance heating member in parallel with each other.

Next, a current detecting section 215 will be described. The current detecting section 215 detects the effective value of the current flowing through the primary side via a current transformer 216. The current detecting section 215 detects the current flowing between the electrode E2 (second electrode) and the electrode E3 (third electrode), and may be utilized to detect a fault of the apparatus. If the relay RL1 and the relay RL2 are operating normally in accordance with the commercial power source voltage, a current of 5 A flows between the electrode E2 and the electrode E3, that is, through the resistance heating member H2, irrespective of whether the commercial power source voltage is 100 V or 200 V. In the case where the second state is established, that is, the resistance heating bodies H1 and H2 are connected in parallel with each other, even if the commercial power source voltage is 200 V, however, a current of 10 A flows between the electrode E2 and the electrode E3. Thus, a fault of the apparatus may be determined if the current detecting section 215 detects a current of 10 A.

The current detecting section 215 outputs Irms1, which is the square of the effective current value, and Irms2, which is the moving average value of Irms1, for each cycle of the commercial power source frequency. The CPU 213 detects the effective current value for each cycle of the commercial power source frequency on the basis of Irms1. The current detecting section 215 may be implemented using a technique proposed in Japanese Patent Laid-Open No. 2007-212503, for example. Irms2 is output to the relay control section 214. When an overcurrent flows through the primary side of the current transformer 216 so that Irms2 exceeds a predetermined upper limit value, the control section 214 actuates RL12 and TR1 latch portions to hold an RL12off signal and a TR1off signal at Low. When these signals are held at Low, the relay RL1 and the relay RL2 are held in the third state, and the triac TR1 is kept off. That is, in the case where the current Irms2 detected by the current detecting section 215 exceeds the predetermined upper limit current, the apparatus is brought into the third state. In the example, the current detecting section 215 detects the current flowing between the electrode E2 (second electrode) and the electrode E3 (third electrode). However, the current detecting section 215 may detect the current flowing between the electrode E1 (first electrode) and the electrode E2 (second electrode).

Next, a voltage detecting section 217 (second voltage detecting section) will be described. The voltage detecting section 217 may also be utilized to detect a fault of the apparatus as with the current detecting section 215. As shown in FIG. 2B, the voltage detecting section 217 detects the voltage between AC4 and AC5. If the relay RL1 and the relay RL2 are operating normally in accordance with the commercial power source voltage, a voltage of 100 V is applied between AC4 and AC5, that is, to the resistance heating member H1, irrespective of whether the commercial power source voltage is 100 V or 200 V. In the case where the second state is established, that is, the resistance heating bodies H1 and H2 are connected in parallel with each other, even if the commercial power source voltage is 200 V, however, a voltage of 200 V is applied between AC4 and AC5. Thus, a fault of the apparatus may be determined if the voltage detecting section 217 detects a voltage of 200 V. When the voltage detecting section 217 detects a voltage of 200 V, a Vlim signal is set to Low. When the Vlim signal is set to Low, the control section 214 actuates the RL12 and TR1 latch portions to hold the RL12off signal and the TR1off signal at Low. Consequently, the relay RL1 and the relay RL2 are held in the third state, and TR1 is kept off. That is, in the case where the voltage detected by the voltage detecting section 217 exceeds a predetermined upper limit voltage, the apparatus is brought into the third state. The contact AC4 is directly coupled to the terminal of RL2 so that the voltage detecting section 217 may detect the voltage even in the case where a wire break occurs in the current transformer 216 or the connector C3 is disconnected. Reference symbol FU1 denotes a current fuse.

As discussed above, the control circuit 210 according to the embodiment is provided with both the current detecting section 215 and the voltage detecting section 217 to detect a fault of the apparatus. However, only one of the detecting sections may be provided. It should be noted, however, that providing both the detecting sections improves the safety and thus is preferable.

Figure 3A:
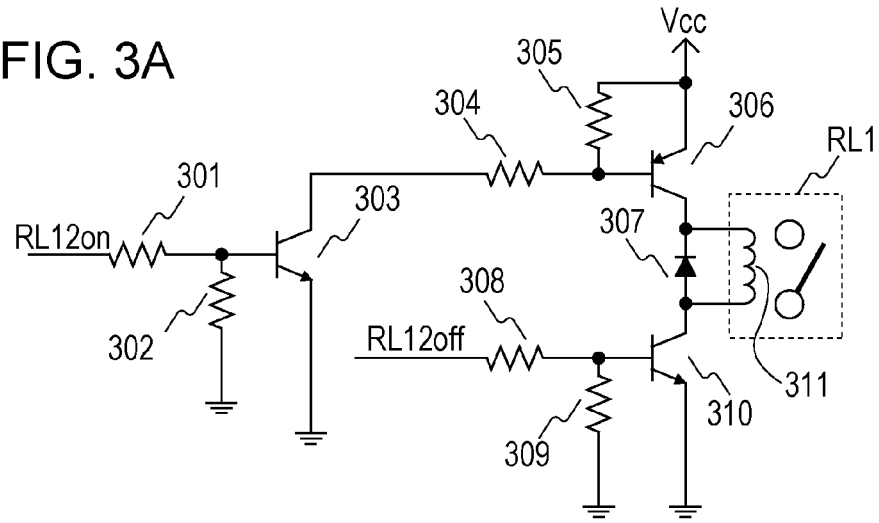
FIGS. 3A to 3C show relay control circuits and a triac control circuit according to the first embodiment.
Figure 3B:
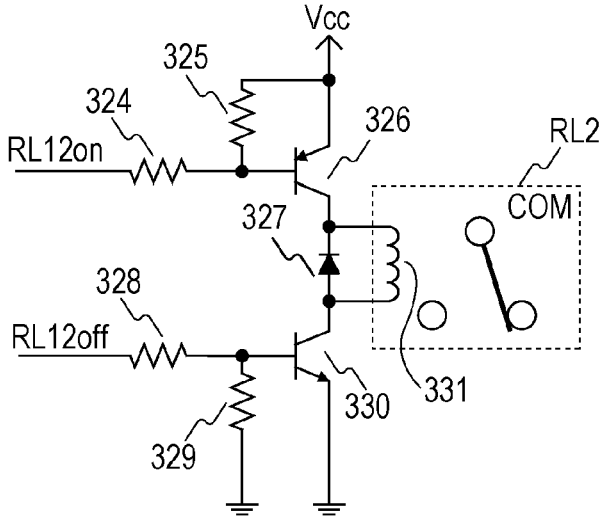
Figure 3C:
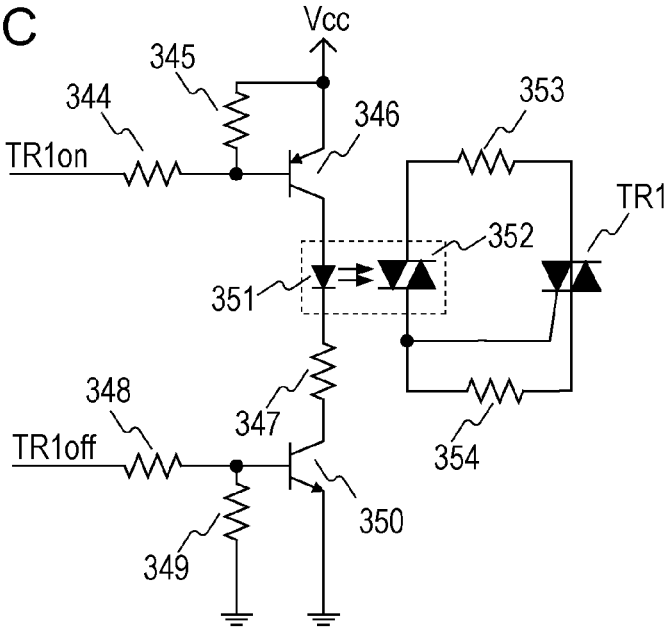

FIGS. 3A to 3C show the drive circuits for the relay RL1, the relay RL2, and the triac TR1, respectively.

FIG. 3A shows the drive circuit for the relay RL1. When RL12on is set to High, a current flows through the base of an NPN transistor 303 to turn on the transistor 303. Reference numerals 301 and 302 denote a resistor used to drive the transistor 303. When the transistor 303 is turned on, a current flows through the base of a PNP transistor 306 to turn on the transistor 306. Reference numerals 304 and 305 denote a resistor used to drive the transistor 306. When RL12off is set to High, a current flows through the base of an NPN transistor 310 to turn on the transistor 310. Reference numerals 308 and 309 denote a resistor used to drive the transistor 310. When the transistor 306 and the transistor 310 are turned on, power is supplied from Vcc to a secondary coil 311 of RL1 to turn on RL1. Reference numeral 307 denotes a surge absorbing diode.

FIG. 3B shows the drive circuit for the relay RL2. When RL12on is set to Low, a current flows through the base of a PNP transistor 326 to turn on the transistor 326. Reference numerals 324 and 325 denote a resistor used to drive the transistor 326. When RL12off is set to High, a current flows through the base of an NPN transistor 330 to turn on the transistor 330. Reference numerals 328 and 329 denote a resistor used to drive the transistor 330. When the transistor 326 and the transistor 330 are turned on, power is supplied from Vcc to a secondary coil 331 of RL2 to turn on RL2. Reference numeral 327 denotes a surge absorbing diode.

FIG. 3C shows the drive circuit for the triac TR1. When TR1on is set to Low, a current flows through the base of a PNP transistor 346 to turn on the transistor 346. Reference numerals 344 and 345 denote a resistor used to drive the transistor 346. When TR1off is set to High, a current flows through the base of an NPN transistor 350 to turn on the transistor 350. Reference numerals 348 and 349 denote a resistor used to drive the transistor 350. When the transistor 346 and the transistor 350 are turned on, power is supplied from Vcc to a secondary light emitting diode 351 of a phototriac coupler 352. Reference numeral 347 denotes a current limiting resistor. When the phototriac 352 is turned on, the triac TR1 is in turn turned on. Resistors 353 and 354 are bias resistors for the triac TR1.

Operations of the relays RL1 and RL2 will be summarized. In the case where the RL12off signal is set to High with power supplied from Vcc, when the RL12on signal is set to Low, the relay RL1 is turned off, and the relay RL2 is turned on (to be connected to the left contact in FIG. 2B) (first state). When the RL12on signal is set to High, the relay RL1 is turned on, and the relay RL2 is turned off (to be connected to the right contact in FIG. 2B) (second state). When the power supply Vcc for the relay drive circuits is turned off, the relays RL1 and RL2 are turned off, which brings the apparatus into the third state. When the RL12 latch portion of the control section 214 is actuated, the RL12off signal is held at Low, which turns off the relays RL1 and RL2 to establish the third state.

FIGS. 4A to 4D illustrate the first state, the second state, and the third state. FIG. 4A illustrates the first state in which the first resistance heating member H1 and the second resistance heating member H2 are connected in series with each other in the case where the power source voltage is 200 V. The resistance values of the resistance heating member H1 and the resistance heating member H2 are assumed to be 20Ω for the purpose of illustration. In the first state, the 20-Ω resistors are connected in series with each other, and therefore the combined resistance value of the heater 200 is 40Ω. Since the power source voltage is 200 V, a current of 5 A is supplied to the heater 200, which results in an electric power of 1000 W. The current I1 for the first resistance heating member H1 and the current I2 for the second resistance heating member H2 are each 5 A. The voltage V1 applied to the first resistance heating member H1 and the voltage V2 applied to the second resistance heating member H2 are each 100 V.

FIG. 4B illustrates the second state in which the first resistance heating member H1 and the second resistance heating member H2 are connected in parallel with each other in the case where the power source voltage is 100 V. In the second state, the 20-Ω resistors are connected in parallel with each other, and therefore the combined resistance value of the heater 200 is 10Ω. Since the power source voltage is 100 V, a current of 10 A is supplied to the heater 200, which results in an electric power of 1000 W. The current I1 for the first resistance heating member H1 and the current I2 for the second resistance heating member H2 are each 5 A. The voltage V1 applied to the first resistance heating member H1 and the voltage V2 applied to the second resistance heating member H2 are each 100 V.

The current, the voltage, and the power supplied to the heater 200 is compared between the states of FIG. 4A and FIG. 4B. In the case where the current I1 or the current I2 is detected, the power supplied to the heater 200 is 1000 W at a current value of 5 A in the state of FIG. 4A, and also 1000 W at a current value of 5 A in the state of FIG. 4B. By detecting a current at an appropriate position as described above, a current that is proportional to the power supplied to the heater 200 may be detected irrespective of whether the first state or the second state is established. This makes it possible to determine whether the apparatus is normal or faulty by detecting the current I1 or I2. The voltage applied to each of the resistance heating bodies H1 and H2 is the product of the current and the resistance value (20Ω). Therefore, the voltage V1 or V2 may be detected in place of the current I1 or I2.

The current detecting section 215 and the voltage detecting section 212 provided at appropriate positions as discussed above may be utilized to limit the power to be supplied to the heater 200. An example of such use will be described. In the case where it is desired to limit the power to be supplied to the heater 200 to 1000 W or less, a current limit may be provided. In the case where the detected current I1 or I2 is utilized, for example, the power to be supplied to the heater 200 may be limited to 1000 W or less by setting the limit of the detected current to 5 A irrespective of whether the first state or the second state is established. A technique disclosed in Japanese Patent No. 3919670 may be used to control the power to a predetermined value or less using the current detection results.

Figure 4C:
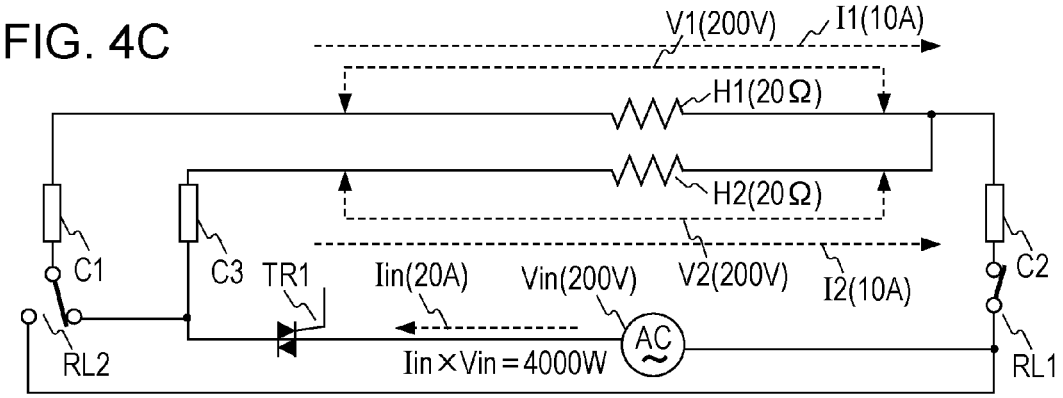

FIG. 4C illustrates a case where the second state in which the heater resistance value is small is established although the voltage of the commercial power source 211 is 200 V because of a fault of the voltage detecting section 212 or the like. In the second state, the combined resistance value of the heater 200 is 10Ω. Since the commercial power source voltage is 200 V, a current of 20 A is supplied to the heater 200, which results in an electric power of 4000 W. The currents I1 and I2 have a current value of 10 A, which is double the value during normal times (FIGS. 4A and 4B). The voltages V1 and V2 have a voltage value of 200 V, which is also double the value during normal times. Thus, the normal state and the faulty state may be differentiated from each other by using the current detecting section 215 and the voltage detecting section 217 provided at appropriate positions as in the example. This makes it possible to detect the faulty state of FIG. 4C. In the state of FIG. 4C, excessive power is supplied to the heater 200. In the case where the faulty state of FIG. 4C is detected, it is necessary to shut off the power to be supplied to the heater 200.

Figure 4D:
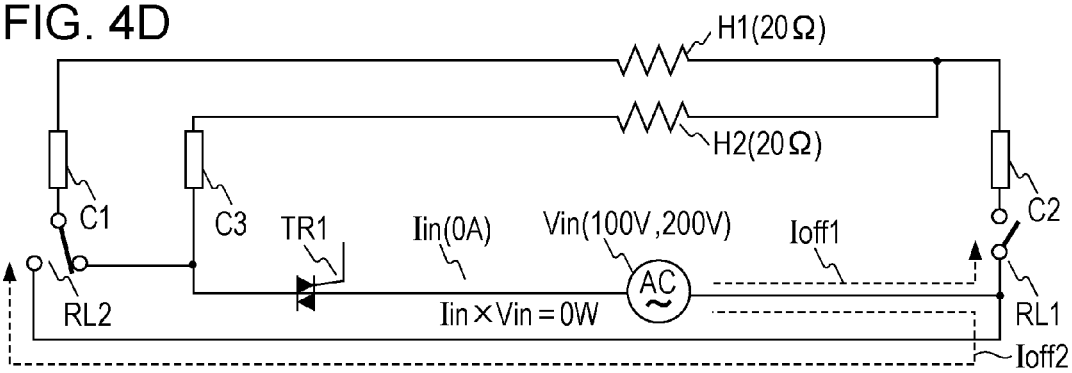

FIG. 4D shows the third state in which the relay RL1 and the relay RL2 are turned off. In this state, a path Ioff1 and a path Ioff2 through which a current for the heater 200 flows are shut off by RL1 and RL2, respectively. Therefore, the power supply to the heater 200 is shut off (the power supply is blocked). As described in relation to FIGS. 3A to 3C, in the case where the power supply Vcc for the relay drive circuits is turned off, or when the RL12off signal is set to Low, RL1 and RL2 are turned off to establish the third state shown in FIG. 4D. In the case where it is necessary to shut off the power supply to the heater 200, it is only necessary to establish the third state. Thus, it is not necessary to separately provide power shutoff relays, which suppresses a cost increase.

A case where the CPU 213 controls the triac TR1 such that the current I2 becomes 5 A or less on the basis of the Irms1 signal output from the current detecting section 215, for example, is described. In the case where an upper limit current Ilim of the current I2 is set to 6 A, the control section 214 actuates the RL12 latch portion when an abnormal current of 6 A or more is detected on the basis of the Irms2 signal output from the current detecting section 215 with power control disabled because of a fault of the triac TR1 or the like. Then, the RL12off signal is set to Low to shut off the power supply to the heater 200. Now, a case where the heater 200 is controlled to 200° C. on the basis of the TH signal from the temperature detecting element 111 is described. In the case where an upper limit temperature Thlim of the temperature of the heater 200 is set to 250° C., the control section 214 actuates the RL12 latch portion when a temperature of 250° C. or more is detected on the basis of the TH signal. Then, the RL12off signal is set to Low to shut off the power supply to the heater 200. Also in the case where the faulty state of FIG. 4C is detected, the control section 214 may actuate the RL12 latch portion, which sets the RL12off signal to Low to shut of the power supply to the heater 200.

As described in relation to FIGS. 3A to 3C, when the power supply Vcc for the relay drive circuits is turned off, the third state is established. Therefore, the power supply to the heater 200 may be kept shut off when Vcc is turned off even if the current detecting section 215, the voltage detecting section 217, and the temperature detecting element 111 are not performing abnormality detection. Accordingly, the safety of the fixing section 100 may be further enhanced by installing the relays RL1 and RL2 such that the third state is established when no power is supplied to the relay drive circuits.

Figure 5A:
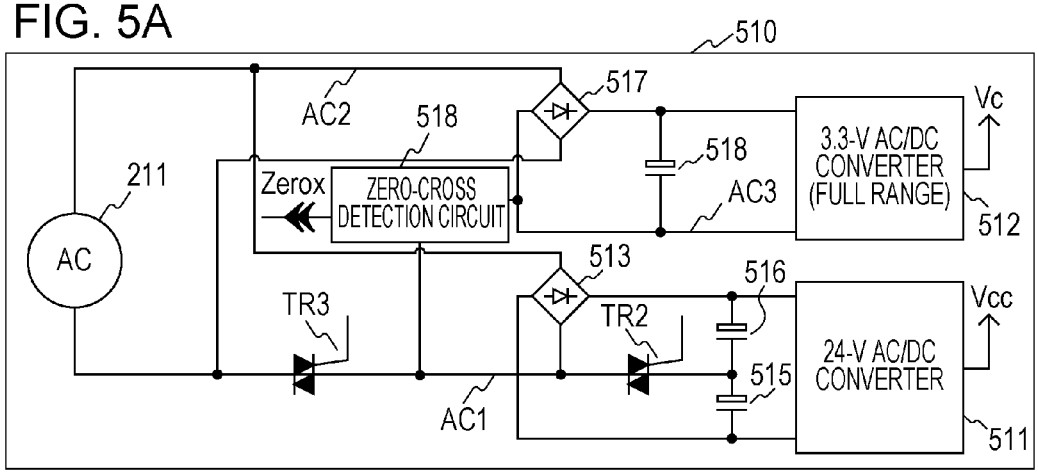
FIGS. 5A to 5C show the circuitry of an AC/DC converter and voltage detecting sections according to the first embodiment.
Figure 5B:
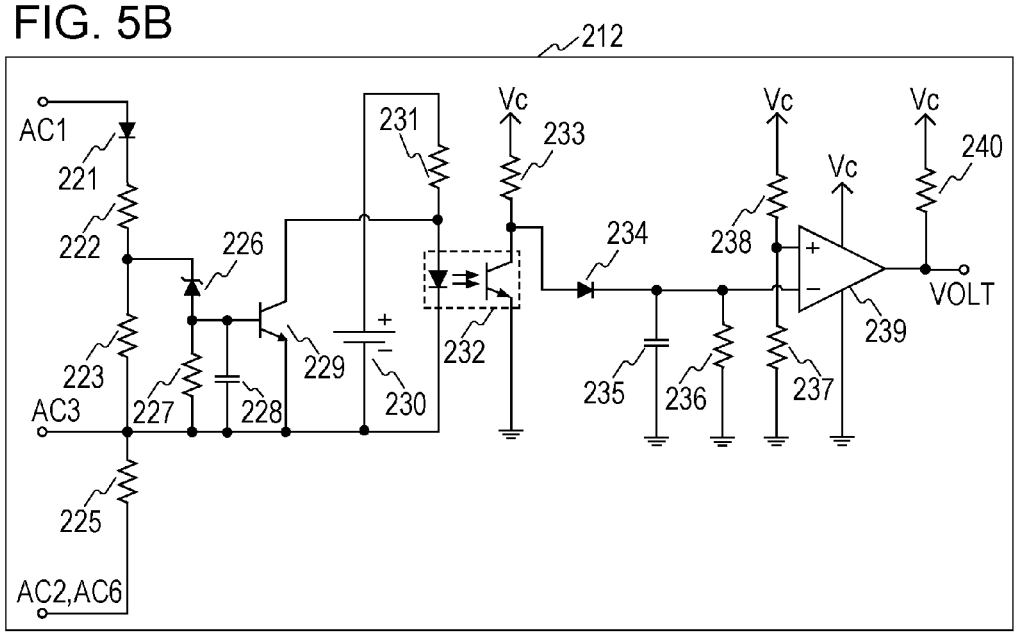
Figure 5C:
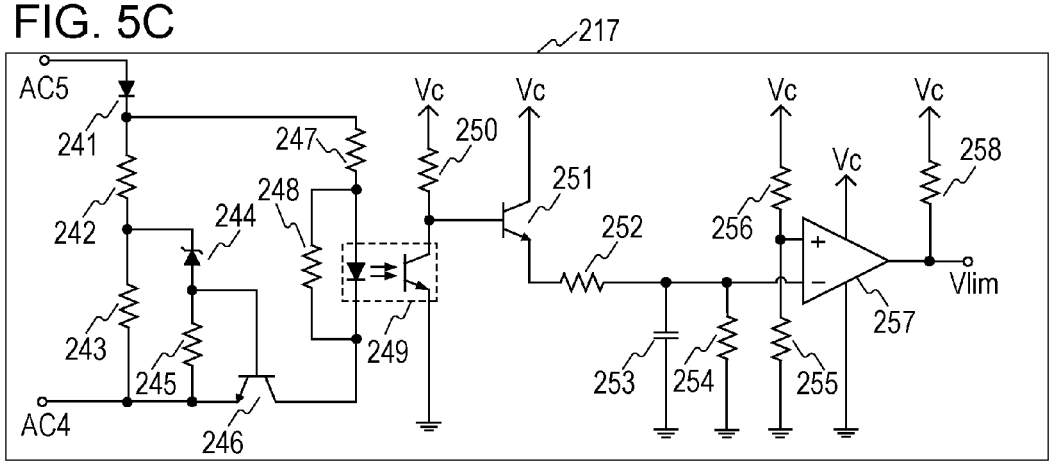

FIGS. 5A to 5C show the circuitry of the power source section 510, the voltage detecting section 212, and the voltage detecting section 217, respectively. The power source section 510 includes a 24-V converter 511 and a 3.3-V converter 512. First, the 24-V converter 511 is described. Reference numeral 513 denotes a bridge diode used to rectify a waveform from the alternating-current power source 211. Reference numerals 515 and 516 denote smoothing electrolytic capacitors. TR2 denotes a triac that switches the 24-V converter 511 between a full-wave rectification state and a voltage-doubler rectification state. TR2 is turned on when a TR2on signal from the CPU 213 is set to High. In the full-wave rectification state, the triac TR2 is turned off, and a voltage rectified by the bridge diode 513 is applied to a combined capacitance value obtained by connecting the capacitors 515 and 516 in series with each other.

In the voltage-doubler rectification state, the triac TR2 is turned on, and a half wave of the alternating-current power source 211 in the positive phase is applied to the electrolytic capacitor 516, and a half wave of the alternating-current power source 211 in the negative phase is applied to the electrolytic capacitor 515. Because the half waves are held at their peak values, substantially twice the voltage applied in the full-wave rectification state is applied to the 24-V converter 511. In the case where the voltage detecting section 212 determines that the range of the power source voltage is around 200 V, the VOLT signal is set to Low, and the CPU 213 turns off TR2 to bring the 24-V converter 511 into the full-wave rectification state. In the case where the voltage detecting section 212 detects that the range of the power source voltage is around 100 V, the CPU 213 turns on TR2 to bring the 24-V converter 511 into the voltage-doubler rectification state.

Next, the 3.3-V converter 512 is described. The 3.3-V converter 512 is a converter operable over a full range irrespective of whether the range of the power source voltage is around 100 V or around 200 V. Reference numeral 517 denotes a bridge diode used to rectify a waveform from the alternating-current power source 211. Reference numeral 518 denotes a smoothing electrolytic capacitor. The 3.3-V converter 512 is used as a power source (output Vc) for a small load such as the CPU 213 and a sensor. Therefore, the converter operable over a full range may be designed relatively easily even in the case where switching between the voltage-doubler rectification state and the full-wave rectification state is not performed. The output Vc of the 3.3-V converter 512 is also used as a power source for the voltage detecting section 212.

On the other hand, the 24-V converter 511 is used as a power source (output Vcc) for a large load such as a motor and the relays RL1 and RL2, and therefore need to output large power. It may be difficult for an AC/DC converter that can output large power and that is in particular not provided with a PFC circuit to operate over a full range without switching between the voltage-doubler rectification and the full-wave rectification. Therefore, the 24-V converter 511 according to the embodiment switches between the voltage-doubler rectification and the full-wave rectification. TR3 denotes a triac for reduction of power consumption. TR3 is turned on when a TR3on signal from the CPU 213 is set to High. Turning off TR3 in the case where the fixing section 100 is turned off or in a power saving state may reduce power consumed by the 24-V converter 511 and power consumed by the voltage detecting section 212. The zero-cross detection circuit 518 outputs the Zerox signal used in power control for the heater 200 or to control the current detecting section 215, and is disposed between AC1 and AC3 to reduce power consumed by the zero-cross detection circuit 518 when the fixing section 100 is turned off or in the power saving state.

FIG. 5B shows the circuitry of the voltage detecting section (first voltage detecting section) 212. The voltage detecting section 212 detects the voltage between AC1 and AC3. In the case where the voltage of AC1 is higher than the voltage of AC2, AC3 is connected to AC2 via the bridge diode 517, and therefore the voltage of AC3 may be substantially obtained by detecting the voltage between AC1 and AC2. The voltage detecting section 212 detects the voltage between AC1 and AC3 to utilize an auxiliary winding voltage VPC to be discussed later. When the voltage applied between AC1 and AC3 becomes a threshold voltage or more, the voltage divided between a resistor 222 and a resistor 223 becomes higher than the Zener voltage of a Zener diode 226. When a voltage is applied to a resistor 227, an npn bipolar transistor 229 is turned on to short-circuit a primary light emitting diode of a photocoupler 232. The power source VPC is a source of a DC voltage supplied with reference to the potential of AC3 by the voltage of an auxiliary transformer winding (not shown) of the AC/DC converter 512. A current flows from VPC to the primary light emitting diode of the photocoupler 232 via a resistor 231. When the transistor 229 is turned off, the primary light emitting diode of the photocoupler 232 is energized. When the voltage applied between AC1 and AC3 becomes high, the transistor 229 is turned on to short-circuit the primary light emitting diode of the photocoupler 232. Therefore, the light emitting diode of the photocoupler 232 does not emit light. Reference numeral 221 denotes a current backflow prevention diode. Reference numeral 228 denotes a capacitor for noise measures. When the light emitting diode of the photocoupler 232 does not emit light and a secondary transistor of the photocoupler 232 is turned off, a charging current flows from Vc to a capacitor 235 via a resistor 233. Reference numeral 234 denotes a current backflow prevention diode. Reference numeral 236 denotes a discharge resistor. When the voltage applied between AC1 and AC3 becomes high to increase the proportion of the time when the primary light emitting diode of the photocoupler 232 is turned off, the charging current flows through the capacitor 235 over an increased time. Therefore, the voltage of the capacitor 235 becomes high. When the voltage of the capacitor 235 becomes higher than a voltage divided by a resistor 237 and a resistor 238 for comparison performed by a comparator 239, a current flows from Vc to an output portion of the comparator 239 via a resistor 240 to set the voltage at the output VOLT to Low. Reference numeral 225 denotes a balance resistor.

FIG. 5C shows the circuitry of the voltage detecting section (second voltage detecting section) 217. When the voltage applied between AC4 and AC5 becomes a threshold voltage (predetermined upper limit voltage) or more, the voltage divided between a resistor 242 and a resistor 243 becomes higher than the Zener voltage of a Zener diode 244. When a voltage is applied to a resistor 245, an npn bipolar transistor 246 is turned on. When the transistor 246 is turned on, a current flows through a primary light emitting diode of a photocoupler 249 via a resistor 247. Reference numeral 241 denotes a current backflow prevention diode. Reference numeral 248 denotes a resistor for prevention of the photocoupler 249. When a current flows through the primary light emitting diode of the photocoupler 249, a secondary transistor of the photocoupler 249 is actuated to cause a current to flow from Vc via a resistor 250 to set a gate voltage of a pnp bipolar transistor 251 to Low. When the transistor 251 is turned on, a charging current flows from Vc through a capacitor 253 via a resistor 252. Reference numeral 254 denotes a discharge resistor. When the voltage applied between AC5 and AC4 is increased to increase the proportion of the time (on-duty period) when a current flows through the primary light emitting diode of the photocoupler 249, a charging current flows through the capacitor 253 over an increased time. Therefore, the voltage of the capacitor 253 becomes high. When the voltage of the capacitor 253 becomes higher than a voltage divided between a resistor 255 and a resistor 256 for comparison performed by a comparator 257, a current flows from Vc to an output portion of the comparator 257 via a resistor 258 to set the voltage at an output Vlim to Low. In the case where the voltage at the output Vlim is set to Low, the control section 214 according to the embodiment determines that the faulty state shown in FIG. 4C has been detected.

Figure 6:
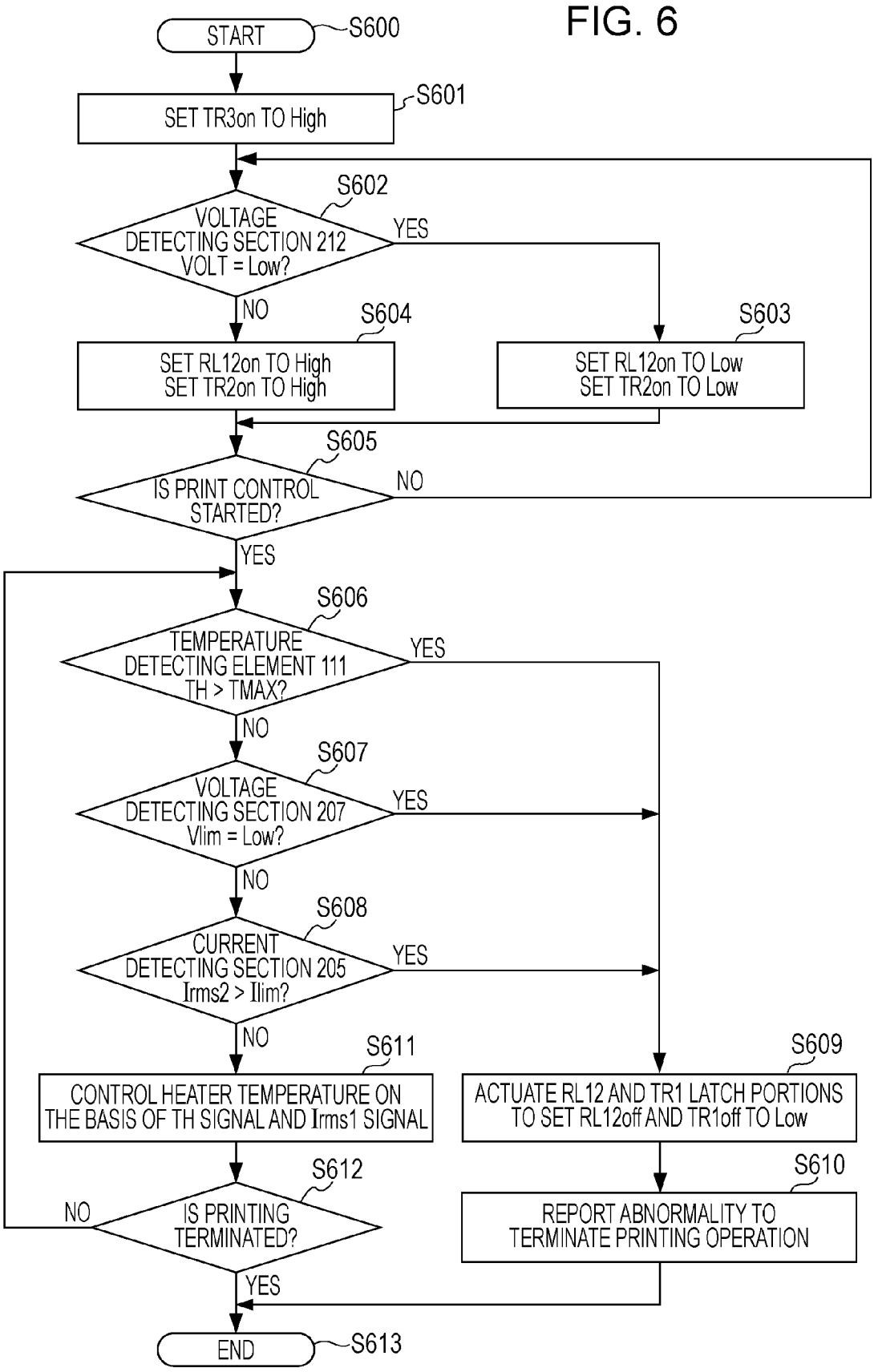
FIG. 6 is a control flowchart according to the first embodiment.

FIG. 6 is a flowchart illustrating a sequence of control for the fixing section 100 performed by the CPU 213 and the control section 214.

In S600, when the control circuit 210 is brought into a standby state, the control is started to proceed to S601. In S601, TR3on is set to High to turn on the triac TR3. In S602, the range of the power source voltage is determined on the basis of the VOLT signal output from the voltage detecting section 212. The process proceeds to S604 in the case where the power source voltage is around 100 V, and to S603 in the case where the power source voltage is around 200 V. In S603, the RL12on signal is set to Low to bring the heater 200 into the first state with a large resistance value. In addition, the TR2on signal is set to Low to bring the 24-V converter 511 into the full-wave rectification state. In S604, the RL12on signal is set to High to bring the heater 200 into the second state with a small resistance value. In addition, the TR2on signal is set to High to bring the 24-V converter 511 into the voltage-doubler rectification state. The processes of S602 to S604 are repeated until it is determined in S605 to start print control. When the print control is started, the process proceeds to S606.

In S606, it is determined whether a temperature higher than the upper limit temperature Tlim of the heater 200 is detected on the basis of the TH signal from the temperature detecting element 111. In the case where a temperature higher than Tlim is detected, the process proceeds to S609.

In S607, in the case where the voltage detecting section 217 detects a voltage around 200 V (faulty state of FIG. 4C), the Vlim signal is set to Low, and the process proceeds to S609.

In S608, in the case where a current value larger than Ilim is detected on the basis of the output Irms2 from the current detecting section 215, the process proceeds to S609.

In S609, the RL12 and TR1 latch portions are actuated to hold RL12off and TR1off at Low to shut off the power supply to the heater 200. Alternatively, the power supply to Vcc may be shut off.

In S610, an abnormality is reported to urgently stop the printing operation. The process proceeds to S613 to terminate the control. In the case where no abnormality is detected in S606, S607, and S608, the process proceeds to S611. In S611, the CPU 213 controls the triac TR1 using PI control on the basis of the TH signal output from the temperature detecting element 111 and the Irms1 signal output from the current detecting section 215 to control power to be supplied to the heater 200 (phase control or wave number control). The processes of S606 to S611 are repeated until it is determined in S612 to terminate the printing. When the printing is terminated, the process proceeds to S613 to terminate the control.

By using the control circuit 210 according to the first embodiment proposed herein as described above, the heater resistance switching relays may be used as power shutoff relays in the fixing section 100 in which the heater resistors are switchably connected in series and in parallel with each other.

(Second Embodiment)

Figure 7A:
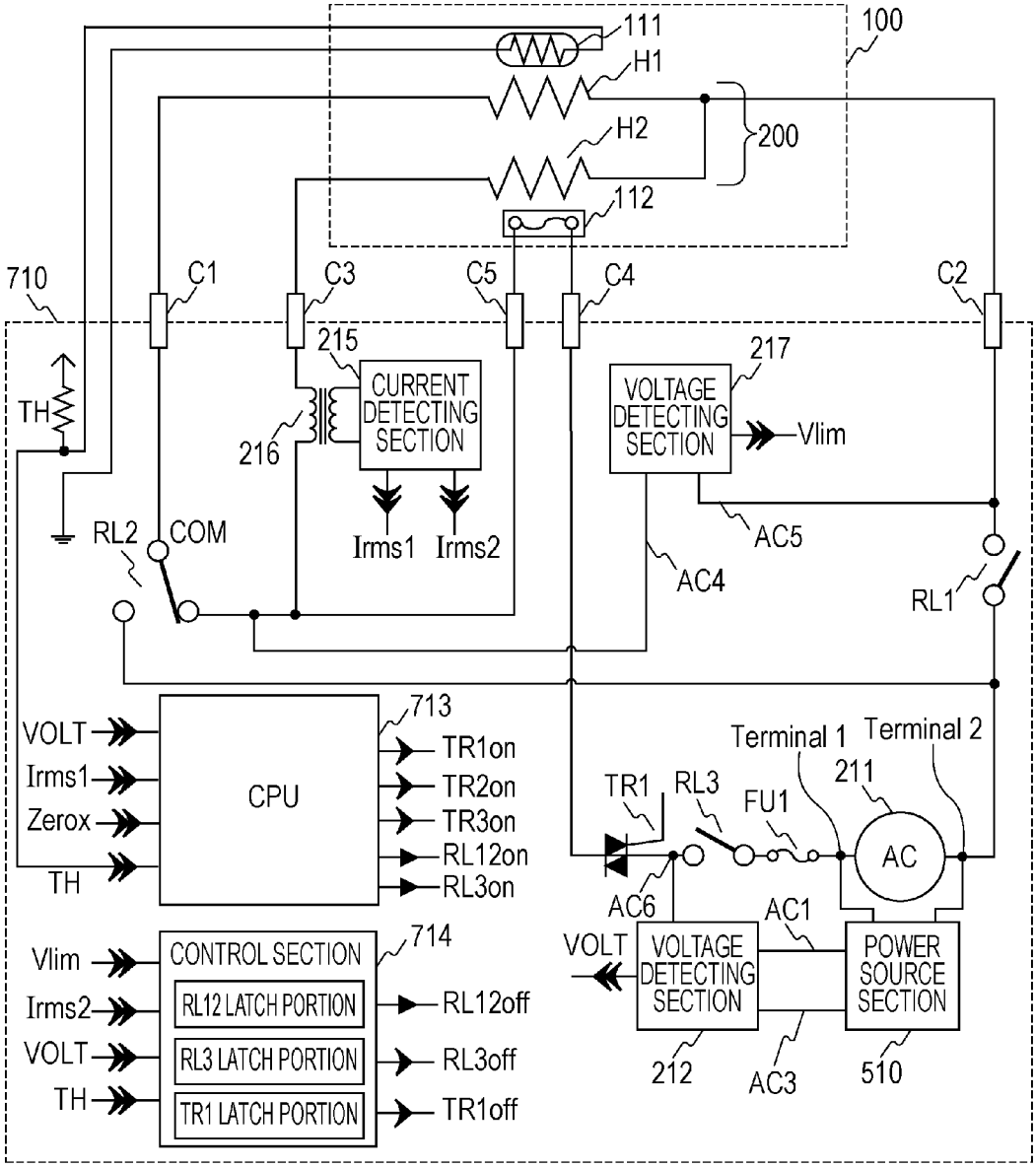
FIGS. 7A and 7B show the configuration of a heater control circuit according to a second embodiment.
Figure 7B:
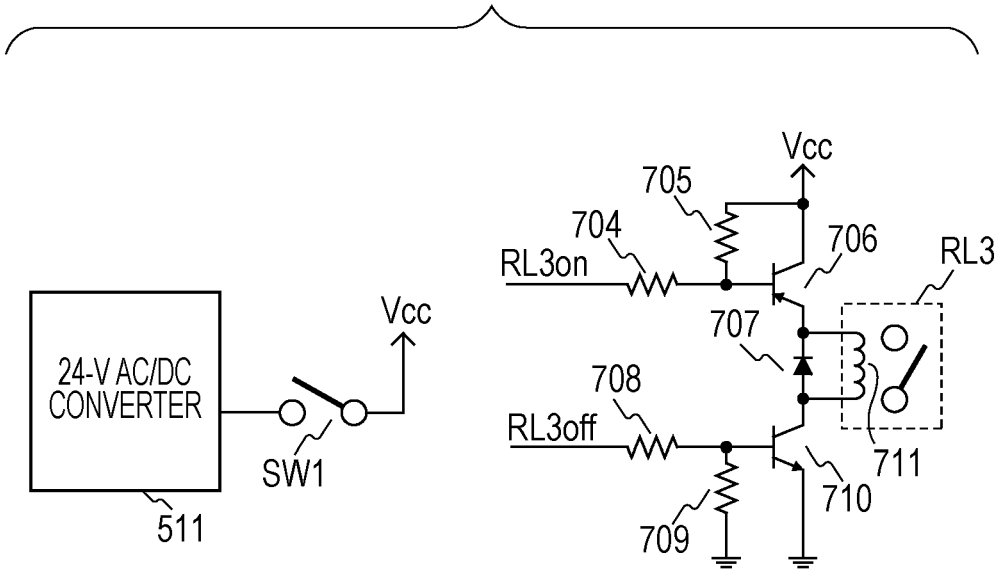

FIGS. 7A and 7B show a control circuit 710 according to a second embodiment. The control circuit 710 in FIG. 7A is obtained by adding a power shutoff relay (third switching unit) RL3 to the control circuit 210 shown in FIG. 2B.

AC 211 and the heater 200 may be electrically insulated from each other by turning off RL3 with the heater 200 in the third state (the state illustrated in FIG. 7A). RL1 is connected to one (Terminal 2) of the two power source terminals of AC 211, and RL3 is connected to the other (Terminal 1). RL1, RL2, and RL3 shown in FIG. 7A show the connection state with the power source 211 turned off.

The current path from the two power source terminals of AC 211 to the heater 200 may be shut off using the triac TR1 in place of the relay RL3, for example. However, the triac TR1 which is a semiconductor drive element may not serve well enough as a safety device for electric shock prevention. AC 211 and the heater 200 may be electrically insulated from each other by disconnecting both the power source terminals of AC 211 from the heater 200 using the relays RL1, RL2, and RL3. In the second embodiment (third embodiment), the balance resistor 225 is connected between AC3 and AC6 to reduce power consumed by the balance resistor 225 in the case where the fixing section 100 is turned off or in the power saving state. When the relay RL3 is turned off, no voltage is applied between AC3 and AC6, and thus power consumed by the balance resistor 225 may be reduced. An insulating resistor may be used for the balance resistor 225.

FIG. 7B shows an interlock switch SW1 and a drive circuit for the relay RL3. Power for the drive circuits for RL1, RL2, and RL3 via SW1 is supplied from the 24-V converter 511. That is, when SW1 is turned off, RL1, RL2, and RL3 are turned off. In some cases, the image forming apparatus is configured such that the fixing apparatus 100 is accessible by a user to allow maintenance, clearance of a paper jam, replacement of the fixing apparatus, or the like. The image forming apparatus is provided with a door (not shown) for access to the fixing apparatus 100, and designed such that the interlock SW1 is turned off with the door open. In general, the fixing apparatus 100 itself has been insulated to prevent an electric shock. The safety can be further enhanced by disconnecting both the terminals of AC 211 using the relays RL1, RL2, and RL3. In the case where the resistor switching relays (RL1 and RL2) are not used as shutoff units, two power shutoff relays are needed to disconnect both the power source terminals of AC 211.

In the drive circuit for RL3, when RL3on is set to Low, a current flows through the base of a PNP transistor 706 to turn on the transistor 706. Reference numerals 704 and 705 denote a resistor used to drive the transistor 706. When RL3off is set to High, a current flows through the base of an NPN transistor 710 to turn on the transistor 710. Reference numerals 708 and 709 denote a resistor used to drive the transistor 710. When the transistor 706 and the transistor 710 are turned on, power is supplied from Vcc to a secondary coil 711 of RL3 to turn on RL3. Reference numeral 707 denotes a surge absorbing diode.

When the interlock switch SW1 is turned off, the power supply to Vcc is shut off, and RL3 is turned off. In addition, in the case where an abnormality is detected in step S609 of FIG. 6, an RL3 latch portion of a control section 714 is actuated to hold RL3off at Low. Accordingly, RL3 is turned off. When the RL3 latch portion is actuated, RL3 may be kept off even when the RL3on signal is set to High.

In the embodiment, as has been described above, when the interlock switch SW is shut off, both the power source terminals of AC 211 are disconnected from the heater 200 using the three relays RL1, RL2, and RL3 to establish the third state. Thus, AC 211 and the heater 200 may be electrically insulated from each other, which further improves the safety of the apparatus.

(Third Embodiment)

Figure 8A:
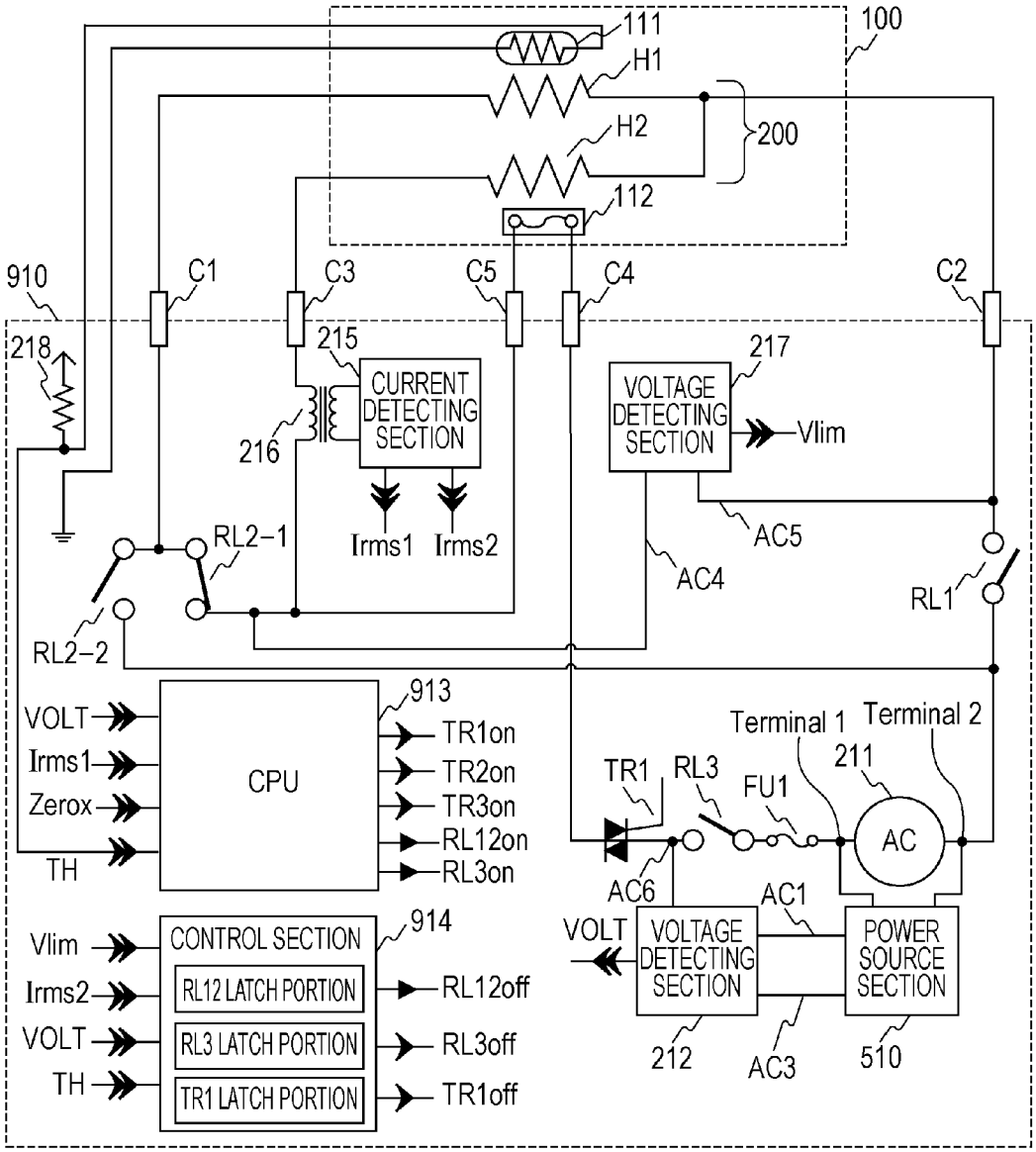
FIGS. 8A and 8B show the configuration of a heater control circuit according to a third embodiment.
Figure 8B:
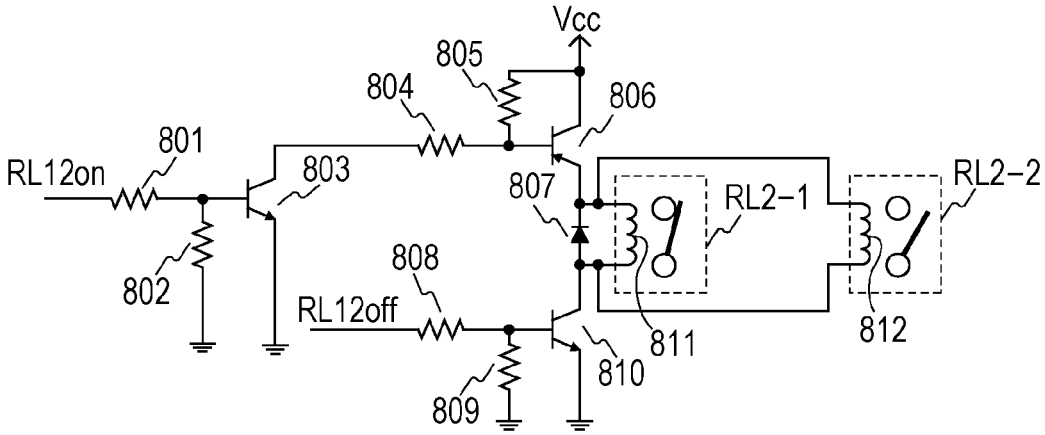

FIGS. 8A and 8B show a control circuit 810 according to a third embodiment.

The control circuit 810 in FIG. 8A illustrates a combined use of a break-contact relay RL2-1 and a make-contact relay RL2-2 in place of the MBM-contact relay RL2 used in the control circuit 710 shown in FIGS. 7A and 7B. RL1, RL2-1, RL2-2, and RL3 shown in FIGS. 8A and 8B show the contact connection state with the power source (Vcc) for relay drive circuits turned off. The break-contact relay RL2-1 is turned on in the case where no power is supplied to a coil 811. The make-contact relay RL2-2 is turned off in the case where no power is supplied to a coil 812. In the first state described in relation to the first embodiment, RL2-1 is turned off, and RL2-2 is turned on. In the second state, RL2-1 is turned on, and RL2-2 is turned off.

FIG. 8B shows the drive circuit for RL2-1 and RL2-2. When RL12on is set to High, a current flows through the base of an NPN transistor 803 to turn on the transistor 803. Reference numerals 801 and 802 denote a resistor used to drive the transistor 803. When the transistor 803 is turned on, a current flows through the base of a PNP transistor 806 to turn on the transistor 806. Reference numerals 804 and 805 denote a resistor used to drive the transistor 806. When RL12off is set to High, a current flows through the base of an NPN transistor 810 to turn on the transistor 810. Reference numerals 808 and 809 denote a resistor used to drive the transistor 810. When the transistor 806 and the transistor 810 are turned on, a current flows through a secondary coil 811 of RL2-1 to turn off RL2-1. In addition, a current flows through a secondary coil 812 of RL2-2 to turn on RL2-2. Reference numeral 807 denotes a surge absorbing diode. In the third embodiment, a make-contact relay and a break-contact relay are used in combination. However, two make-contact relays may be used instead. A make-contact relay and a break-contact relay may have a better contact gap than that of an MBM-contact relay. Therefore, it is effective to use a make-contact relay and a break-contact relay in place of an MBM-contact relay.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279884 filed Dec. 15, 2010, which is hereby incorporated by reference herein in its entirety.

What is claimed is:

1. An image forming apparatus comprising:

an image forming section that forms an image on a recording material;

a fixing section that fixes the image onto the recording material, the fixing section including an endless belt, a heater that includes a first resistance heating member provided between a first electrode and a second electrode and a second resistance heating member provided between the second electrode and a third electrode and that contacts an inner surface of the endless belt, and a nip portion forming member that forms a fixing nip portion together with the heater via the endless belt, the fixing nip portion being configured to pinch and convey the recording material carrying the image;

a first switching unit provided on a power supply path between the second electrode and a second power source terminal of a commercial power source;

a second switching unit provided on the power supply path so as to switch whether the first electrode is connected to a first power source terminal of the commercial power source or the second power source terminal;

a semiconductor drive element that is provided on a path through which power is supplied from the first power source terminal to the heater and that controls the power;

a third switching unit provided on the power supply path between the semiconductor drive element and the first power source terminal; and a voltage detecting section that detects a voltage of the commercial power source, wherein the third electrode is connected to the first power source terminal, wherein the image forming apparatus is switchable between a first state in which the first switching unit shuts off the power supply path and the second switching unit is connected to the second power source terminal to connect the first resistance heating member and the second resistance heating member in series with each other, and a second state in which the first switching unit closes the power supply path and the second switching unit is connected to the first power source terminal to connect the first resistance heating member and the second resistance heating member in parallel with each other, wherein the image forming apparatus has a third state in which the first switching unit shuts off the power supply path and the second switching unit is connected to the first power source terminal to block power supply to the heater, wherein the apparatus is automatically switched between the first state and the second state in accordance with the voltage detected by the voltage detecting section, wherein drive power for the first switching unit and the second switching unit is shut off in the third state, and wherein the third switching unit shuts off the power supply path and drive power for the third switching unit is shut off in the third state.

2. The image forming apparatus according to claim 1, further comprising:

an interlock switch, wherein the apparatus is brought into the third state when the interlock switch is shut off.

3. The image forming apparatus according to claim 1, wherein the apparatus is brought into the third state in the case where a temperature of the heater exceeds a predetermined upper limit temperature.

4. An image forming apparatus comprising:

an image forming section that forms an image on a recording material;

a fixing section that fixes the image onto the recording material, the fixing section including an endless belt, a heater that includes a first resistance heating member provided between a first electrode and a second electrode and a second resistance heating member provided between the second electrode and a third electrode and that contacts an inner surface of the endless belt, and a nip portion forming member that forms a fixing nip portion together with the heater via the endless belt, the fixing nip portion being configured to pinch and convey the recording material carrying the image;

a first switching unit provided on a power supply path between the second electrode and a second power source terminal of a commercial power source;

a second switching unit provided on the power supply path so as to switch whether the first electrode is connected to a first power source terminal of the commercial power source or the second power source terminal;

a voltage detecting section that detects a voltage of the commercial power source, and a current detecting section that detects a current flowing through the power supply path, wherein the third electrode is connected to the first power source terminal, wherein the image forming apparatus is switchable between a first state in which the first switching unit shuts off the power supply path and the second switching unit is connected to the second power source terminal to connect the first resistance heating member and the second resistance heating member in series with each other, and a second state in which the first switching unit closes the power supply path and the second switching unit is connected to the first power source terminal to connect the first resistance heating member and the second resistance heating member in parallel with each other, wherein the image forming apparatus has a third state in which the first switching unit shuts off the power supply path and the second switching unit is connected to the first power source terminal to block power supply to the heater, wherein the apparatus is automatically switched between the first state and the second state in accordance with the voltage detected by the voltage detecting section, wherein drive power for the first switching unit and the second switching unit is shut off in the third state, wherein the current detecting section is provided on the power supply path after branching toward the first resistance heating member and the second resistance heating member in the second state, and wherein the apparatus is brought into the third state in the case where the current detected by the current detecting section exceeds a predetermined upper limit current.

5. An image forming apparatus comprising:

an image forming section that forms an image on a recording material;

a fixing section that fixes the image onto the recording material, the fixing section including an endless belt, a heater that includes a first resistance heating member provided between a first electrode and a second electrode and a second resistance heating member provided between the second electrode and a third electrode and that contacts an inner surface of the endless belt, and a nip portion forming member that forms a fixing nip portion together with the heater via the endless belt, the fixing nip portion being configured to pinch and convey the recording material carrying the image;

a first switching unit provided on a power supply path between the second electrode and a second power source terminal of a commercial power source;

a second switching unit provided on the power supply path so as to switch whether the first electrode is connected to a first power source terminal of the commercial power source or the second power source terminal;

a first voltage detecting section that detects a voltage of the commercial power source, and a second voltage detecting section that detects a voltage applied between the first electrode and the second electrode or a voltage applied between the second electrode and the third electrode, wherein the third electrode is connected to the first power source terminal, wherein the image forming apparatus is switchable between a first state in which the first switching unit shuts off the power supply path and the second switching unit is connected to the second power source terminal to connect the first resistance heating member and the second resistance heating member in series with each other, and a second state in which the first switching unit closes the power supply path and the second switching unit is connected to the first power source terminal to connect the first resistance heating member and the second resistance heating member in parallel with each other, wherein the image forming apparatus has a third state in which the first switching unit shuts off the power supply path and the second switching unit is connected to the first power source terminal to block power supply to the heater, wherein the apparatus is automatically switched between the first state and the second state in accordance with the voltage detected by the first voltage detecting section, wherein drive power for the first switching unit and the second switching unit is shut off in the third state, and wherein the apparatus is brought into the third state in a case where the voltage detected by the second voltage detecting section exceeds a predetermined upper limit voltage.

* * * * *